US005388391A

United States Patent [19]

Parker

[11] Patent Number: 5,388,391

[45] Date of Patent: Feb. 14, 1995

[54] APPARATUS AND PROCESS FOR PACKAGING BIOHAZARDOUS WASTES

[76] Inventor: Richard D. Parker, Rt. 1, Box 58A, Rose Bud, Mo. 63091

[21] Appl. No.: 286,050

[22] Filed: Dec. 19, 1988

[51] Int. Cl.[6] ..... B65B 1/24; B65B 25/00; B65B 61/20

[52] U.S. Cl. ..... 53/527; 53/157; 53/238

[58] Field of Search ..... 53/527, 157, 238; 422/292, 294, 28; 220/402, 404, 409; 100/229 A

[56] References Cited

U.S. PATENT DOCUMENTS

| | | | |
|---|---|---|---|
| 2,384,709 | 9/1945 | Thoren | 220/402 |
| 2,558,028 | 6/1951 | Winters | 53/238 |
| 3,438,321 | 4/1969 | Gladwin | 53/527 |
| 3,683,638 | 8/1972 | Devon | 62/264 |
| 3,868,903 | 3/1975 | Montalbano | 53/527 |
| 4,008,658 | 2/1977 | Stock et al. | 53/527 |
| 4,041,858 | 8/1977 | Gustavsson | 53/527 |
| 4,084,497 | 4/1978 | Khan | 53/527 |
| 4,275,651 | 6/1981 | Groth et al. | 53/527 |
| 4,448,750 | 5/1984 | Fuesting | 422/20 |
| 4,564,469 | 1/1986 | Cochet et al. | 53/527 |
| 4,638,730 | 1/1987 | Boracorsi | 53/527 |
| 4,715,572 | 12/1987 | Robbins, III et al. | 220/404 |
| 4,902,482 | 2/1990 | Faust | 422/292 |
| 4,980,132 | 12/1990 | Stinson et al. | 422/292 |

OTHER PUBLICATIONS

Sweet's Catalog File; Products for General Building & Renovation, McGraw Hill Publishing Co., 1988, p. 3, Sec. 11,172 and p. 5, Sec. 11,600.

*Primary Examiner*—Donald E. Czaja
*Assistant Examiner*—Anthony Weier
*Attorney, Agent, or Firm*—Jerome A. Gross

[57] ABSTRACT

A new apparatus is provided as part of a system for use in hospitals and the like, which safely stores and packages biohazardous wastes. The upper portion of the apparatus includes a pneumatically operated descending pressure plate and anti-pathogen provisions. The lower portion encloses a slide-out compartment in which disposable waste containers are placed. Bags containing such wastes are deposited in the container from time to time and are continually exposed to ultraviolet light, while air is drawn away for filtering and safe discharge. When several bags of waste have been so deposited, a planar divider for the waste container is pressed downward, gently leveling the bags of waste beneath it, while the air expelled is sprayed with an anti-pathogenic spray. These operations are repeated using a succession of such dividers until a container has been substantially filled; it is then removed for disposal. Novel safety features are incorporated in the pneumatic circuitry.

6 Claims, 4 Drawing Sheets

FIG. 5
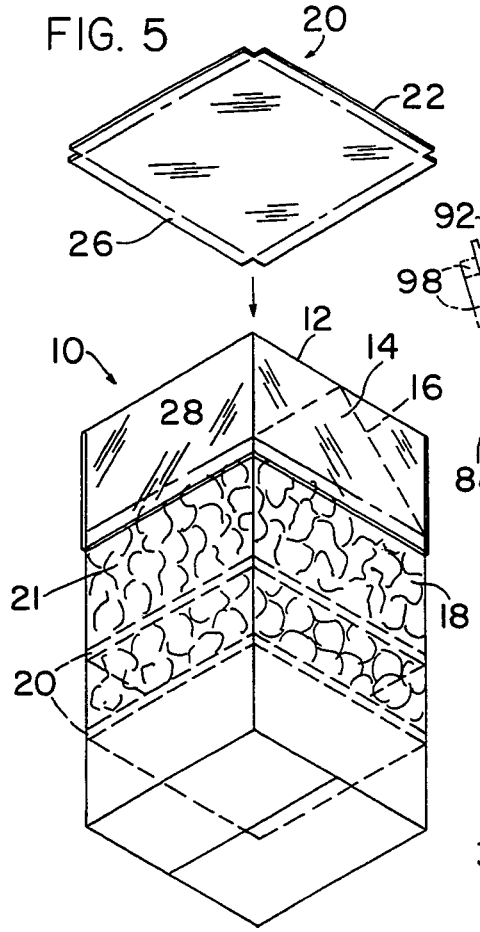
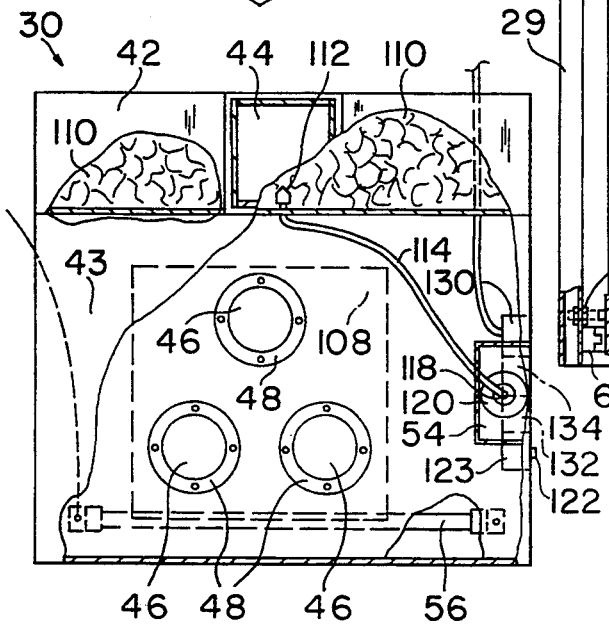
FIG. 4
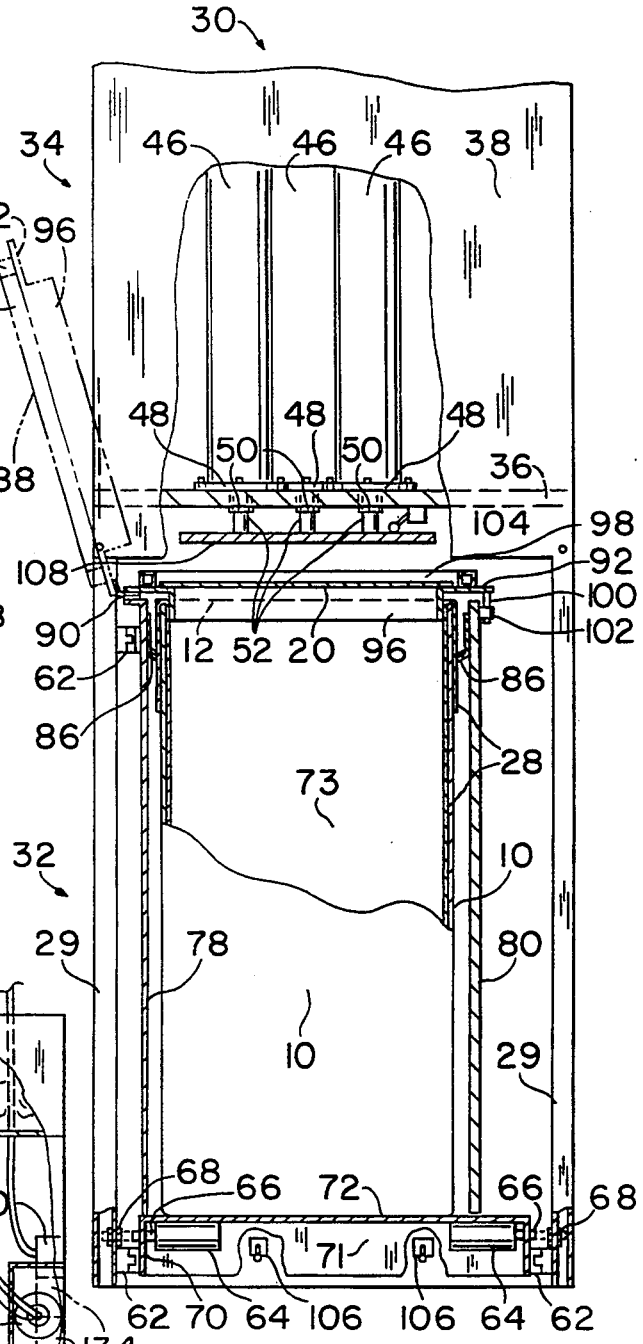
FIG. 2

APPARATUS AND PROCESS FOR PACKAGING BIOHAZARDOUS WASTES

FIELD OF THE INVENTION

This invention relates to the safe temporary storage and final packaging of wastes containing biohazardous contaminants which may become airborne, for example, those wastes of hospital surgery rooms.

DESCRIPTION OF RELATED ART

Infectious wastes produced, for example, by hospitals, research laboratories, and nursing homes must temporarily be stored on site and ultimately packaged for shipment and disposal. Such packaging cannot be done safely by hand, due to pathogens which contaminate the waste, the inner surfaces of the waste container and the air which has passed over the wastes or the contaminated surfaces. Personnel may be exposed to potential infection when depositing waste into the container, as well as in sealing and transporting such waste containers.

Waste deposit sites in hospitals, etc., have been provided with devices which irradiate and apply antipathogenic sprays to small quantities of wastes, as well as withdrawing pathogen laden air from the vicinity. To the present inventor's knowledge, no such device has served to also safely package biohazardous wastes for disposal. Such wastes, sometimes called "red bag" wastes, are usually preliminarily placed in plastic bags which are subject to being punctured or broken.

Familiar compactor devices severely compress wastes, rather than merely leveling such wastes for safe efficient packaging. Such devices are unsuitable for use with "red bag" wastes.

SUMMARY OF INVENTION

The present invention provides a system for safe temporary storage of biohazardous wastes and for their final packaging for transport and incineration.

The system includes a preferably corrugated cardboard, disposable open-topped waste container. The container is lined with a plastic bag and is provided with disposable dividers to be positioned horizontally between successive deposits of waste. The dividers serve to level and separate individual waste deposits and shield the operator during deposits of waste and sealing the container.

The apparatus of the system is housed in a cabinet which has upper and lower compartments and an air-withdrawal plenum at the rear. The upper compartment houses an ultraviolet lamp and a unique pneumatic mechanism, which operates the apparatus, including a safety lock-up and load-transfer, linear actuators for a downward-extending pressure plate, and an antipathogenic spray mechanism.

The storage and packaging functions are carried out in the lower compartment of the cabinet. It consists principally of a drawer, which receives and permits removal of a preferably corrugated, disposable, open-topped waste container. A frame fitted into the top of the drawer, centers the waste container and the disposable dividers in position for being gently inserted downward by the pneumatically controlled pressure plate onto the biohazardous wastes.

BRIEF DESCRIPTION OF THE DRAWINGS

FIG. 2 is a sectional view of the apparatus of FIG. 1, taken along line 2—2, portions thereof being broken away.

FIG. 4 is a top plan view, partly broken away, of the apparatus of FIG. 1.

FIG. 5 is an isometric view of a partly-filled waste container, utilized as part of the present invention, with a plurality of dividers within it, shown in broken lines and another divider positioned thereabove.

DESCRIPTION OF THE PREFERRED EMBODIMENT

Figure 1:
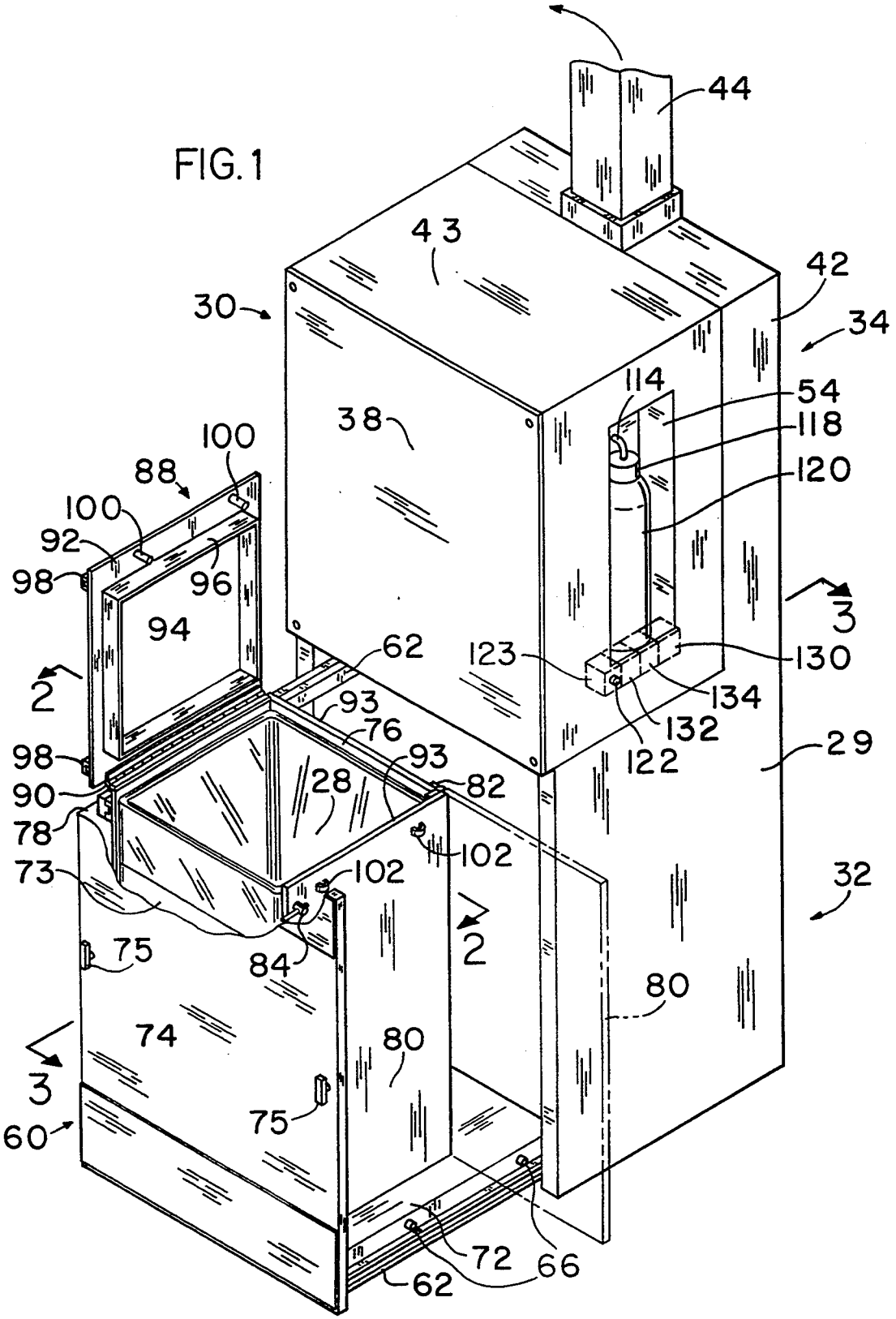
FIG. 1 is an isometric illustration, partly broken away, of the present apparatus for packaging biohazardous wastes, with the lower portion opened forward, showing a waste container in place.

An apparatus, generally designated 30, for safe temporary storage and packaging of biohazardous waste by a series of deposits in a disposable waste container, is illustrated in FIGS. 1–4. Such a waste container, generally designated 10 and shown in FIG. 5, is preferably constructed of heavy corrugated cardboard and is rectangular, so that when open it has a vertical inner sidewall 18. Its closable top portion 14 terminates in an upper edge 12 which is preferably continuous and folds in upon itself along 45 degree scored lines 16 on alternate sides of the top portion 14. Each container 10 is preferably lined by a disposable plastic liner 28 of greater depth than the container 10; while being filled and before closing the container 10, the excess depth is folded over and outward of the container upper edge 12, as seen in FIGS. 1 and 5.

Each successive waste deposit is to be leveled and topped by pressing the waste gently downward with a disposable planar divider 20. Each divider 20 is constructed of corrugated cardboard and has scored bend lines 24 near its outer edge 22. The bend lines 24 define an area slightly smaller than the cross-section of the container 10, leaving margins 26 which bend upwardly and engage the container inner sidewall 18 (or a liner 28 within it) when the divider 20 is pressed downward within the container 10.

The apparatus 30 includes rigid left and right structural sidewalls 29 common to both a lower enclosure portion 32 and an upper enclosure portion 34, which are separated by a shelf 36. The shelf does not extend to the structural rear wall 37, seen in FIG. 3, but only to an intermediate upper transverse wall 39; the space between it 39 and the rear wall 37 is referred to as the plenum 42. The upper enclosure portion 34 has a front access panel 38 attached by retainer screws 40; the front panel 38 extends downward somewhat below the shelf 36.

As seen in FIGS. 1 and 4, the plenum 42 is vented, at the rear of the enclosure top wall 43, by vent means 44 which lead to an external source of negative air pressure, for example a fan by which air is exhausted externally.

Three pneumatic linear actuators 46, each having a base mounting flange 48, are bolted onto the shelf 36, preferably equidistant from each other and so located as to be centered with reference to a waste container compartment 73, hereafter described, located slidingly in the lower enclosure portion 32. Rods 52 of the actuators 46 extend downward through bushings 50 in the shelf 36.

A cabinet recess 54 is conveniently located in the right sidewall 29 of the upper enclosure portion 34, for receiving a bottle 120 of germicidal liquid, hereafter referred to. An ultraviolet anti-pathogenic lamp 56 is positioned closely beneath the shelf 36, just behind the lower portion of the front access panel 38 and shielded by it from view.

Figure 3:
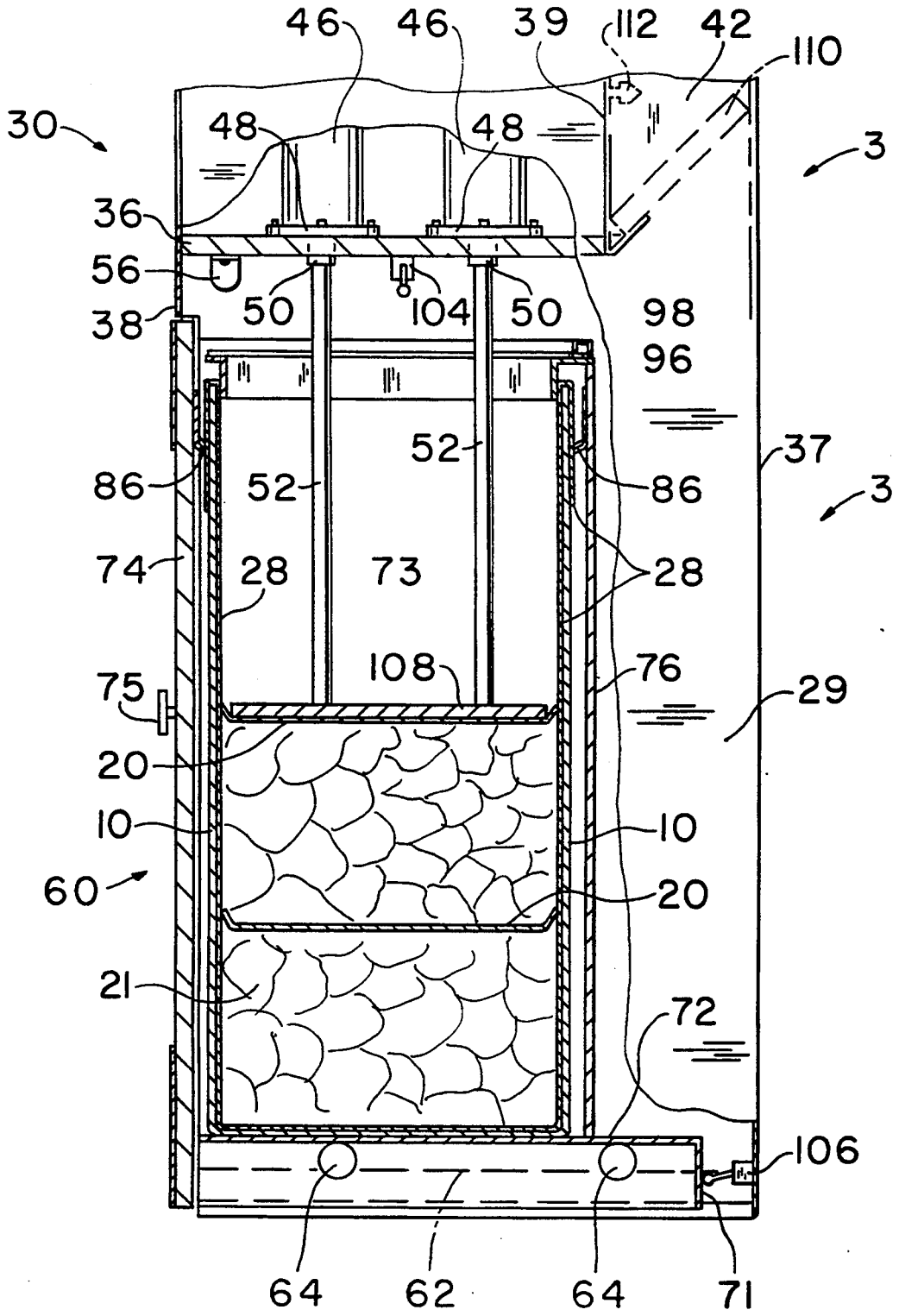
FIG. 3 is a fragmentary sectional view taken along line 3—3 of FIG. 1, with the lower portion closed, illustrating the packaging of such wastes in a waste container.

The enclosure lower portion 32 contains slide-out structure, generally designated 60, which is supported and positioned by conventional telescoping drawer slides 62, one set mounted near the inner lower ends of both left and right sidewalls 29 of the lower enclosure portion 32 and a third set on its left wall 78 in a higher position, as seen in FIG. 1. The two lower sets of drawer slides 62 are mounted on side beams 70 which, together with a rear beam 71 seen in FIG. 3, support a floor 72 of the slide-out structure 60. The side beams 70 are subject to being locked by slide-out compartment pneumatic lock-up linear actuators 64 preferably two on each side as seen in FIGS. 2 and 3. The actuators 64 are mounted to and beneath the floor 72 of the slide-out structure 60. When the slide-out structure 60 is fully closed, the rods 66 of the actuators 64 (shown retracted in FIG. 2) extend outward and lock into bushings 68 mounted in the lower compartment sidewalls 29, as seen in FIG. 2.

The principal function of the slide-out structure 60 is to support a compartment, generally designated 73, for a waste container such as that designated 10 in FIG. 5. As seen in the perspective view FIG. 1, the compartment 73 is of smaller plan form than the slide-out structure 60, occupying its front left portion. A forward wall 74, closing the lower enclosure portion 32 in front of and between the structural sidewalls 29, is rigidly attached to the beams 70 and floor 72 of the slide-out structure 60; this forms the forward wall of the waste container compartment 73. The wall 74 has left and right handles 75. Also rigidly mounted on the slide-out structure 60 (sometimes herein called the "drawer") is a back compartment wall 76, spaced from the forward wall 74 a distance sufficient to accommodate (with necessary clearance, as hereinafter described) a disposable waste container 10. A left wall 78 is similarly mounted rigidly onto the slide-out structure 60, and is afforded additional support by the upper drawer slide 62. Along the right edge of the back compartment wall 76 is a continuous hinge 82, mounting an openable door 80 which when closed, extends to the forward wall 74, somewhat to the left of the right edge of the wall 74, as seen in FIG. 1. The door 80 is preferably latched by conventional rotary latch means 84.

The interior of the rectangular compartment 73 so formed by these compartment walls 74, 76, 78 and door 80 is slightly greater than the external dimensions in plan form of the waste container 10. Strips of leaf springs 86, seen in FIGS. 2 and 3, attached horizontally to the upper portions of these walls 74,76,78 and door 80, press inwardly against the bag-covered sidewalls 18 of a container 10 when placed within the compartment 73, thus centering the container 10 therein.

An upwardly tiltable rigid metal frame 88 is attached, just above the upper edge of the upturned container top portion 14, by a horizontal hinge 90 to the left wall 78 of the slide-out compartment 60; it is raised upwardly as seen in phantom lines in FIG. 2. The frame 88 has a planar outer flange 92 outward of a rectangular central opening generally designated 94, which is horizontal when the frame 88 is in lowered operating position; the opening 94 is defined by the frame's rectangular depending flange 96. This flange 96 fits closely inside the container top portion 14, when a container 10 is centered therein by the leaf springs 86. Conventional ball pins 100 extend downward from the right side of the outer flange 92. When the frame is lowered to horizontal operating position, the ball pins 100 fit latchingly into frame alignment eyes 102 projecting outwardly from the openable door 80 near its upper edge. When in such horizontal operating position, the frame 88 is supported by the hinge 90, and by resting its outer flange 92 on the upper edges 93 of the back wall 76 and the openable door 80.

Small square tubes 98 welded onto the planar flange 92 on its left, right and back sides, define an area corresponding with the outer dimensions of a planar divider 20; the fourth edge of this area is defined by the aft side of the forward wall 74. Within this area, a planar divider 20 is placed, as shown in FIG. 2.

A replaceable air sterilizing filter 110, seen in FIGS. 3 and 4, fits across the space between the rear wall 37 and the intermediate upper wall 39 and is accessible when the slide-out structure 60 is drawn forward.

Figure 6:
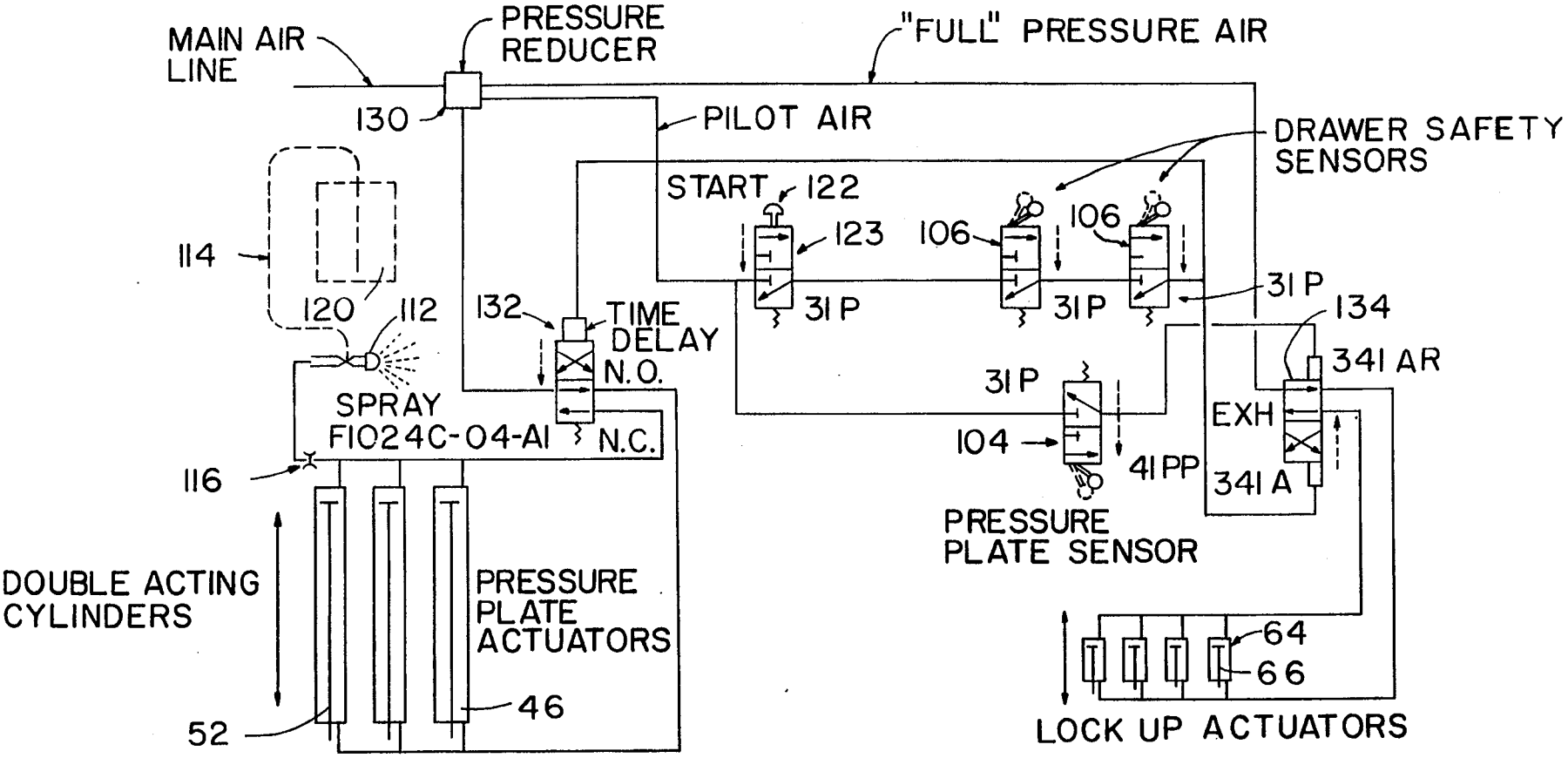
FIG. 6 is a diagramatic view of the pneumatic circuitry of the present invention.

An atomizing spray nozzle 112 supported by the intermediate wall 39 is positioned just above the air filter 110 near the center of the plenum 42, as seen in FIG. 4. The venturi connection of the spray nozzle 112 shown schematically in FIG. 6, is connected by a tube 114 to the screw cap 118 of a bottle 120 containing anti-pathogenic liquid, supported within the recess 54 in the upper portion of the right sidewall 29, as seen in FIGS. 1 and 4. To control the spray volume, an adjustable needle-type valve restrictor 116 (shown schematically in FIG. 6) is preferably included in the pressure air tube to the spray nozzle 112.

To operate the apparatus 30 as generally illustrated in FIG. 3, preliminary reference may be made to the elements of the pneumatic circuit shown in FIG. 6. To be certain that the slide-out structure 60 is fully closed, two slide-out "drawer" safety sensor valves 106 are mounted on the rear wall 37, in position to be operatively contacted by the rear beam 71 of the slide-out structure 60 when in the fully closed position shown in FIG. 3. When in that position the frame 88 is aligned immediately below a horizontal planar pressure plate 108, mounted onto the lower ends of the actuator rods 52 of the main linear actuators 46 which are erected on the shelf 36. The pressure plate 108 is so sized as to fit through the central opening 94 of the rigid frame 88 with sufficient clearance to accommodate the thickness of the margin 26 of a divider panel 20, to be bent up, as shown in phantom lines in FIG. 3, as the pressure plate 108 descends through the frame opening 94.

As part of the pneumatic circuitry of FIG. 6, a pressure plate position-sensing valve 104, whose position is shown in FIGS. 2 and 3, is attached to the underside of the shelf 36; it is engaged upwardly as shown in FIG. 6, when the planar pressure plate 108 is in its uppermost position, FIG. 2; and released as the pressure plate 108 starts downward movement. Thus, FIG. 6 illustrates the pneumatic components in their "waiting" positions, when the slide-out structure 60 is closed (tilting the actuating levers of the drawer safety sensor valves 106 from the phantom line to the solid line positions shown in FIG. 6), and the pressure plate 108 is raised fully upward (tilting up the actuating lever of the pressure plate sensor valve 104). In this position both the pressure plate actuators 46 and the lock-up actuators 64 will be subjected to full pressure air to hold these actuating cylinders in fully retracted position; no impediment is offered to opening and closing the slide-out structure or drawer 60.

The components of a preferred pneumatic control circuit, FIG. 6, for operating the present apparatus, will now be described in greater detail. Main air from a supply source enters the apparatus through a conventional pressure reducer 130, which branches to supply air at both a higher pressure (referred to as "full pressure") and a lower pilot pressure. As long as the pressure plate 108 is not moved from its normal raised position, full pressure air is supplied to hold the linear actuators 46 in raised position, and also to hold the lock-up actuators 64 retracted.

Pilot air pressure is afforded only when, while both the drawer safety valves 106 are closed (i.e., their actuating levers are held by the slide-out structure 60 in the solid line positions of FIG. 6) and a start control button 122 of the start valve 123 is held down at least momentarily. The position of the start button on the right side wall 29 is shown in FIGS. 1 and 4. Each of these valves 106, 123 is preferably of the 31P, spring-return, normally closed type. Holding down the start button 122 when the slide-out structure 60 is closed provides pilot pressure for operating the separate control valves 132, 134 for the separate circuits which operate the pressure plate actuators 46 and the lock-up actuators 64 respectively.

The pressure plate operating circuit, in detail, is as follows: The control valve 132 for the pressure plate actuators 46 is a time-reversing valve preferably of the F1024C-04-A1 type. As soon as it receives such pilot pressure, it reverses its position from that shown in FIG. 6; that is, instead of supplying full pressure air to hold the actuators 46 retracted upward as shown, it supplies such air to their upper ends, driving the pressure plate 108 down (as shown in FIG. 3) until the pneumatic pressure exerted by them is balanced by resistance offered by waste 21 beneath the panel divider 20 of FIG. 3. The pressure reducer 130 is set to reduce the "full" pressure sufficiently that bags of waste 21 beneath the divider 20 will not burst; the force of the descending pressure plate 108 will merely level them to a feasible extent.

The full pressure air so fed to the upper ends of the actuators 46 is fed in part to an adjustable restrictor 116 and thence to the atomizing spray nozzle 112. The drop in its pressure, as it is accelerated in passing through the venturi of the nozzle 112, lifts and entrains the anti-pathogenic liquid, drawing it from its bottle 120.

On expiration of the time for which the valve 132 is set, it automatically reverses, its spring returning it to its position shown in FIG. 6. The full pressure air then flows instead to the under sides of the pistons in the actuators 46, driving them upward and expelling the air above the pistons through the restrictor 116 and to the spray nozzle 112. Hence, air is delivered to the spray nozzle 112 from the time the pressure plate 108 starts its descent until it has returned to fully raised position. This sprays the pathogen-laden air drawn from the waste container 10 or forced from it as a planar divider 20 is driven downward as in FIG. 3.

The lock-up cylinder circuit, in detail, is as follows: The supply of operating pressures to lock and unlock the lock-up actuators 64 is controlled by the position of the pressure plate sensor 104. Like the drawer safety sensors 106, it is preferably of the 31P normally closed type. However, it prevents the lock-up cylinder control valve 134 from accepting a signal to engage the lock-up actuators 64 until the pressure plate 108 commences to lower; and causes these actuators 64 to retract when the pressure plate 108 returns to its fully raised position.

As shown in FIG. 6, the lock-up control valve 134 is preferably of the 41PP type having an exhaust port. The valve 134 is equipped with a 341A control on one side, responsive to pilot air pressure fed in series through the start valve 123 and drawer safety sensor valves 106; and on the opposite side it has a 341AR type control responsive to pilot air fed through the pressure plate sensor valve 104. The 341AR control overrides the 341A control. As long as the pressure plate sensor valve 104 is closed to feed pilot pressure to the 341AR control, the rods 66 of the lock-up actuators 64 remain retracted, as shown in FIG. 2. However, as soon as the pressure plate 108 begins its descent, as described above, the pressure plate sensor valve 104 drops open; then the pilot pressure fed to the 341A side of the control valve 134 reverses it to apply full pressure above the pistons of the lock-up actuators 64, so that their rods 66 extend and enter the bushings 68 in the structural side walls 29.

When, after the time of reversal of the valve 132, the pressure plate 108 returns to its uppermost position, its contact causes the pressure plate sensor valve 104 to supply pilot pressure to the 341AR side of the control valve 134. Its valve position is thereby reversed, to supply full pressure to retract the lock-up actuators 64, and driving the air above their pistons out, to and through the exhaust port of the valve 134.

The function of the lock-up actuators 64 is not only to prevent the slide-out structure 60 from being moved from closed position while the pressure plate 108 is down; importantly, they transfer the down load exerted by the pressure plate 108 from the slide-out structure 60 directly to the side wall structure 29, avoiding the imposition of the pressure plate force on the drawer slides 62.

In use of the present invention the operator manually opens the slide-out structure 60, lifts the tiltable frame 88 and subsequently unlatches and opens the door 80 of the compartment 73 which is supported on the slide-out structure 60. The operator then places within the compartment 73 a disposable cardboard waste container 10 with its upper portion 14 fully opened. The container 10 has been lined, preferably with a plastic bag 28 that has a depth sufficiently greater than that of the container 10 so that it can be draped over the upper edge 12 of the container 10 and held in place by leaf springs 86 on the upper inside walls of the container compartment 73. The door 80 is then closed and latched and the rigid frame 88 is lowered into position so that its depending flange 96 fits snugly within the plastic-lined container 10, the outer flange rests upon the upper edges 93 of the door 80, and the left 78 and rear 76 walls of the compartment. The ball pins 100 will then simultaneously lock into the frame alignment eyes 102 on the door 80.

At this point the operator can deposit biohazardous wastes through the horizontal central opening 94 of the rigid frame 88 into the plastic-lined disposable waste container 10. Such wastes are normally enclosed in small plastic bags 21, shown in FIG. 5. If only a small amount of waste is disposed of at one time, the user may then close the slide-out structure 60 and the ultraviolet lamp 56, which operates continually, will control any pathogens on the outside of the bag 21. Once sufficent waste is accumulated within the container 10, the operator then places a disposable cardboard planar divider 20 on the rigid frame 88 so that it rests within the square tubes 98 which are located along the upper left, right and rear sides of the rigid frame's outer flange 92. The slide-out structure 60 is then closed completely, until its rear beam 71 contacts the two drawer safety sensor valves 106 located at the inner base of the apparatus 30 rear wall 37.

In this position the apparatus 30 can be safely operated. The user presses the control button 122 which is attached to the pneumatic spring-release start valve 123 to initiate the pneumatic system previously described. The pneumatic system causes the drawer lock-up actuators 64 to extend their rods 66 into bushings 68 mounted in the left and right apparatus structural side walls 29, preventing the drawer 60 from being opened and transferring the load from the drawer slides 62 to the apparatus side walls 29. The pressure plate 108 then descends through the rigid frame 88, pressing the planar divider 20 downward into the waste container 10. As it passes through the frame 88, the divider's margins 26 are bent upward along the score lines 24. The margins 26 then flex outward so that as the pressure plate continues its descent, the edges 22 of the divider 20 wipingly contact the walls of the container 10. The plate 108 continues to move downward until the waste within the container 10 has been somewhat leveled and the time delay, spring-release valve 132 allows it to return. When the pressure plate 108 ascends from the container 10 it leaves the planar divider 20 in place over the just deposited waste.

On both descent and ascent of the pressure plate 108, air being removed through the rear plenum 42 via the vent 44 is sprayed with a anti-pathogenic liquid and filtered. The interior of the lower cabinet portion 32 is constantly exposed to ultraviolet light by a lamp 56 which is placed out of the view of the operator.

When the plate 108 has reached its uppermost position, as shown in FIG. 2, rods 66 of the drawer lock-up actuators 64 return to their retracted position and the user can again open the apparatus 30 and repeat the process of depositing waste, positioning a divider 20 and operating the apparatus 30 until the container 10 is substantially filled. The container 10 can then be removed from the compartment 73 and sealed for shipping and disposal. Sealing the container 10 requires unfolding the plastic bag 28 from the edge of the container 10, closing the bag 28, folding the upper portion 14 of the container 10 in upon itself along scored bend lines 16 and then securing the closed upper portion 14, preferably with tape.

As various modifications may be made in the constructions herein described and illustrated without departing from the scope of the invention, it is intended that all matter contained in the foregoing description or shown in the accompanying drawings shall be interpreted as illustrative rather than limiting.

I claim:

1. Apparatus for safe temporary storage and packaging of biohazardous wastes in a disposable rectangular waste container, comprising an upper portion including downward-extending means terminating in a horizontal rectangular pressure plate, and having, beneath said upper portion, a slide-out compartment having four vertical sides, further having compartment floor means to support an open-top disposable rectangular container of such cross-section as to receive said pressure plate; one of which sides is an openable door extending to said floor means, said slide-out compartment further having, at such height above its said floor means as to fit onto the open top of such container, a rigid rectangular open frame having an inner edge extending downward, whereby to fit within the top opening of such waste container and accommodate passage therethrough of said pressure plate, said frame further having outer edge means to support said frame, relative to said slide-out compartment, with the frame inner edge raised above the top opening of such waste container, whereby, when the frame is so supported with its inner edge so raised, such waste container may be readily moved along said compartment floor means for removal and replacement.

2. Apparatus as defined in claim 1, wherein said slide-out compartment includes a portion having four vertical sides, one of which sides is an openable door extending to said floor means.

3. Apparatus as defined in claim 1, together with means, extending horizontally along said four vertical sides, at a level below that of said rigid frame, to exert pressure resiliently inward, whereby to press against the outer sides of such container rested on the floor of said compartment, and by such pressure to bring the container into registration with said frame, and, if such container has a plastic liner drawn outwardly and downwardly over its side walls, to maintain such portion of such plastic liner as said pressure plate moves within the container.

4. Apparatus for safe temporary storage and downward leveling of biohazardous wastes, comprising an enclosure having vent means through which air is drawn for filtering and discharge, said enclosure including a compartment in which such wastes may be received, a pressure plate and means to cause said pressure plate to descend downwardly into said compartment and retract upwardly therefrom, said means including a pneumatic means to drive said pressure plate downward and remove it upward, means to exhaust air from said pneumatic means while such pressure plate is moving downward and upward, atomizer-type means to spray an anti-pathogenic liquid into the air in advance of said air vent means, and means to duct air, exhausted by said pressure plate driving pneumatic means, to operate said atomizer-type means both during the descent and the return upward of said pressure plate.

5. A waste leveling apparatus comprising actuator means terminating in a downward-movable pressure plate, a lower enclosure portion including sidewall structure having horizontal drawer slides, a slide-out compartment normally housed within said sidewall structure and there supported by said drawer slides, control means to initiate descent of the pressure plate into said slide-out compartment, and load-transfer means, effective on the initiation of such descent, to extend substantially horizontally between said slide-out compartment and said sidewall structure, to transfer the load exerted by said pressure plate to the sidewall structure and to by-pass the drawer slides, together with means, effective on return of said pressure plate to upward position, to withdraw said horizontally-extending load transfer means, and thereby return the support of said compartment to said drawer slides.

6. A safe-lock and load transfer system for use with apparatus having a base structure, a slide-out compartment normally supported inwardly of said base structure by drawer slide means which in turn is supported by such base structure, and a pressure applying member operable to descend from an upper position downward into such slide out compartment and to return upward to such upper position, the said safe-lock and load transfer control system comprising bolt-like load transfer means, effective on the initiation of such descent, to extend said load transfer means substantially horizontally between such slide-out compartment and such base structure, whereby to avoid pressure loading such drawer slides, and, effective on such return to such upward position, to withdraw said bolt-like load transfer means from such extended locking position.

* * * * *